US006896361B2

(12) United States Patent
Sugiyama

(10) Patent No.: US 6,896,361 B2
(45) Date of Patent: May 24, 2005

(54) METHOD OF MANUFACTURING INK JET HEAD AND INK JET HEAD

(75) Inventor: Jun Sugiyama, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 100 days.

(21) Appl. No.: 10/602,367

(22) Filed: Jun. 23, 2003

(65) Prior Publication Data

US 2004/0017433 A1 Jan. 29, 2004

(30) Foreign Application Priority Data

Jun. 25, 2002 (JP) ..... 2002-184421

(51) Int. Cl.[7] ..... B41J 2/045
(52) U.S. Cl. ..... 347/71
(58) Field of Search ..... 347/71, 40, 85; 29/890.1

(56) References Cited

U.S. PATENT DOCUMENTS 5,880,763 A * 3/1999 Tanaka et al. ..... 347/70
6,460,965 B2 * 10/2002 Ikegami et al. ..... 347/20
2003/0048335 A1 3/2003 Sugiyama

FOREIGN PATENT DOCUMENTS

JP 10-044420 A 2/1998
JP 2001-162201 6/2001

* cited by examiner

*Primary Examiner*—Thinh Nguyen
(74) *Attorney, Agent, or Firm*—Frishauf, Holtz, Goodman & Chick, P.C.

(57) ABSTRACT

In the present invention, at the time of bonding a top plate with an ink supply member pre-bonded thereto to one side of a head substrate directly or indirectly through a thermosetting adhesive to close grooves formed in the head substrate, or at the time of later bonding an ink supply member through a thermosetting adhesive to a top plate which has been bonded directly or indirectly to a head substrate, the bonding is carried out while applying to the head substrate and the top plate such a load as maintains the head substrate and the top plate in parallel with each other after curing of the adhesive. Therefore, even if the thermal expansion coefficient of the ink supply member is higher than that of the head substrate or even if the thermal expansion coefficients of both ink supply member and top plate are higher than the thermal expansion coefficient of the head substrate, it is possible to prevent warping of the head substrate and the top plate at the time of curing of the thermosetting adhesive and hence possible to facilitate aligning of nozzles.

7 Claims, 11 Drawing Sheets

METHOD OF MANUFACTURING INK JET HEAD AND INK JET HEAD

CROSS REFERENCE OF THE RELATED APPLICATION

This application is based upon and claims the benefit of priority from the prior Japanese Application No. 2002-184421, filed on Jun. 25, 2002, the entire contents of which are incorporated herein by reference.

BACKGROUND OF THE INVENTION

1. Field of the Invention

The present invention relates to a method of manufacturing an ink jet head, as well as the ink jet head.

2. Discussion of the Background

Reference will first be made to the construction of a conventional ink jet head. FIG. 12(A) is a perspective view showing an example of a conventional ink jet head and FIG. 12(B) is an explanatory diagram showing an arrangement of nozzles.

The conventional ink jet head illustrated therein, which is indicated at H1, is made up of a head substrate 101 formed with plural grooves (to be described later) for the supply of ink, a nozzle plate 102 bonded to a front end face of the head substrate 101, a channel-formed member 103 bonded to one side of the head substrate 101, a top plate 104 which closes a top side of the channel-formed member 103, and an ink supply member 105 bonded to the top plate 104.

The channel-formed member 103, which has a frame-like shape, is for internally intercommunicating the plural grooves formed in the head substrate 101. The head substrate 101 is formed by a piezoelectric member and aside wall is formed between adjacent ones of the plural grooves formed in the head substrate 101, with an electrode to be described later being formed inside each groove.

By applying voltage to the electrode, the side walls located on both sides of the groove are deformed and the volume of the groove changes at high speed. The ink jet head H1 is constructed such that ink is fed into the groove during expansion of the groove volume, while during contraction of the groove volume, the ink present inside the groove is ejected through an associated one of nozzles 106 formed in the nozzle plate 102. In the example of the illustrated ink jet head H1, an actuator for ejecting ink is constituted by both a piezoelectric material as the material of substrates 107 and 108 and electrodes which apply voltage to the piezoelectric material.

Next, a detailed construction of the conventional inkjet head H1, as well as a manufacturing process for the head, will be described below. FIGS. 13 to 20 are explanatory diagrams showing an ink jet head manufacturing process.

First, as shown in FIG. 13, there are provided two substrates 107 and 108 formed of a piezoelectric material polarized in the plate thickness direction and then the substrates are bonded together so as to be opposite to each other in the direction of polarization to form a laminate substrate 109.

Next, as shown in FIG. 14, plural grooves 110 are formed in one side of the substrate 108 so as to span the bonded surfaces of the two substrates 107 and 108, whereby there is formed a head substrate 101 having plural grooves 110 and side walls 111 as partition walls between adjacent grooves 110. The grooves 110 can be formed easily by a grinding work which uses, for example, a diamond wheel of a dicing saw for cutting IC wafer. The size of each groove 110 is determined according to the specification of the ink jet head H1.

Then, as shown in FIG. 15, electrodes 112 are formed on inner surfaces of the grooves 110, and wiring patterns 113 connected respectively to the electrodes 112 are formed on one side of the head substrate 101. The electrodes 112 and the wiring patterns 113 are formed by-an electroless plating method using a wet process.

Subsequently, as shown in FIG. 16, a frame-like channel-formed member 103 formed with a channel 103*a* at its center is bonded to one side of the head substrate 101.

Next, as shown in FIG. 17, the head substrate 101 and the channel-formed member 103 are cut off at the front-end side of the grooves 110. This cutting work is performed for making the grooves 110 uniform in length. Indicated at 114 is a cut piece resulting from this cutting work.

Then, as shown in FIG. 18, a nozzle plate 102 is bonded to the front ends of the head substrate 101 and the channel-formed member 103, and nozzles 106 are formed in the nozzle plate 102.

As subsequent steps, as shown in FIG. 19, a top plate 104 with an ink supply member 105 pre-bonded thereto is bonded to an upper surface of the channel-formed member 103, or as shown in FIG. 20, first the top plate 104 is bonded to the upper surface of the channel-formed member 103 and thereafter the ink supply member 105 is bonded to an ink supply hole 104*a* formed in the top plate 104.

In case of adopting the method wherein the nozzle plate 102 pre-formed with nozzles 106 is bonded to the head substrate 101, the position where the nozzle plate 102 is bonded must be controlled strictly in order to align the centers of the grooves 110 with the centers of the nozzles 106. However, this work is difficult. Therefore, there sometimes is adopted a method wherein, after the nozzle plate 102 has been bonded to the head substrate 101, plural nozzles 106 are formed in the nozzle plate 102 in alignment with the centers of the grooves 110. In case of adopting this method, there is used either a method wherein with the nozzles 110 kept open, the nozzles 106 are formed from inside the nozzle plate 102, and a method wherein the nozzles 106 are formed from outside the nozzle plate 102. For forming nozzles in the former case or for removing cut chips from the grooves 110 in the nozzle forming work in the latter case, it is necessary that the nozzles 106 be formed before the top plate 104 is bonded to the head substrate 101 (in the state shown in FIG. 18).

Since the top plate 104 is a flat member of a simple shape, it permits a wide selection range of materials having a thermal expansion coefficient equal to that of the head substrate 101. However, as to the ink supply member 105, its material selection range is narrow because it is complicated in structure which is attributable to its relation of connection to an ink supply system and also because a high strength thereof is required. For this reason there often is used a metallic ink supply member 105.

Therefore, even if there is used a thermosetting adhesive in bonding the substrates 107 and 108 with each other, or bonding the head substrate 101 and the channel-formed member 103 with each other, or bonding the channel-formed member 103 and the top plate 104 with each other, there is no fear of warp of those members in the course of hardening of those members.

However, as shown in FIG. 19, in the case where the top plate 104 with the ink supply member 105 pre-bonded thereto is bonded to the channel-formed member 103, heat which reaches 100° C. or so during hardening of the thermosetting adhesive is transferred to the ink supply member 105 from the top plate 104. Since the ink supply member 105 made of metal is higher in thermal expansion coefficient than the top plate 104, it contracts largely while the conducted heat drops to a lower temperature, and pulls the top plate 104 longitudinally from outside to inside. As a result, the top plate 104, which is a thin plate, is curved upward in FIG. 19. Consequently, the channel-formed member 103, head substrate 101 and nozzle plate 102, which are bonded in this order to the top plate 104, are also deformed following the curving of the top plate 104.

Further, as shown in FIG. 20, when the metallic ink supply member 105 is bonded through a thermosetting resin to the top plate 104 bonded onto the channel-formed member 103, the temperature of the ink supply member 105 and that of the top plate 104 rise due to heat which reaches 100° C. or so during hardening of the thermosetting adhesive, and the ink supply member 105 contracts largely while the heat drops to a lower temperature, pulling the top plate 104 longitudinally from outside to inside. As a result, as is the case with FIG. 19, the thin top plate 104 is curved and the channel-formed member 103, head substrate 101 and nozzle plate 102 are also deformed following the curving of the top plate 104.

Thus, no matter which of the methods shown in FIGS. 19 and 20 may be adopted, the nozzles 106 located inside both-end nozzles become misaligned relative to a virtual straight line A which connects the centers of nozzles 106 located at both ends, as shown in FIG. 12(B).

The curing temperature of the thermosetting adhesive differs for example like 120°, 100° C., 80° C., and 60° C., depending on the adhesive selected.

Additionally, in case of fabricating the ink supply member 105, a rise of the manufacturing cost is unavoidable because the selection range of a material having a thermal expansion coefficient equal to that of the head substrate 101 is narrow.

SUMMARY OF THE INVENTION

Accordingly, it is an object of the present invention to provide a method of manufacturing an ink jet head, as well as the ink jet head, permitting alignment of a large number of nozzles without being influenced by the difference of material.

The above object is achieved by a novel ink jet head manufacturing method and a novel ink jet head according to the present invention.

According to the novel ink jet head manufacturing method of the present invention, at the time of bonding a top plate with an ink supply member pre-bonded thereto to one side of a head substrate directly or indirectly through a thermosetting adhesive to close grooves formed in the head substrate, the head substrate and the top plate for closing the grooves are bonded together while keeping the two superimposed one on the other and in a state in which there is applied to the head substrate and the top plate such a load as maintains the two parallel to each other after curing of the adhesive. Alternatively, at the time of bonding the ink supply member, from behind the top plate, through a thermosetting adhesive to the top plate bonded directly or indirectly to the head substrate, the head substrate and the top plate for closing the grooves are bonded together while applying a load to them so that both are kept parallel to each other also after curing of the adhesive.

According to the novel ink jet head of the present invention, in a mutually fixed state of the head substrate, the top plate and the ink supply member by bonding, the nozzles are arranged at positions at which the distance of each nozzle center deviated from a virtual straight line is not larger than 5 $\mu$m, the virtual straight line joining the centers of nozzles located at both ends or thereabouts in the nozzle arranged direction.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1A:
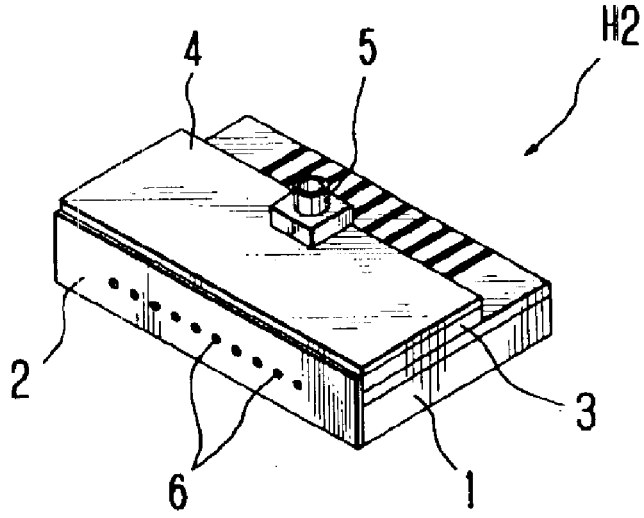
FIG. 1(A) is a perspective view showing the construction of an ink jet head according to a first embodiment of the present invention.
Figure 1B:
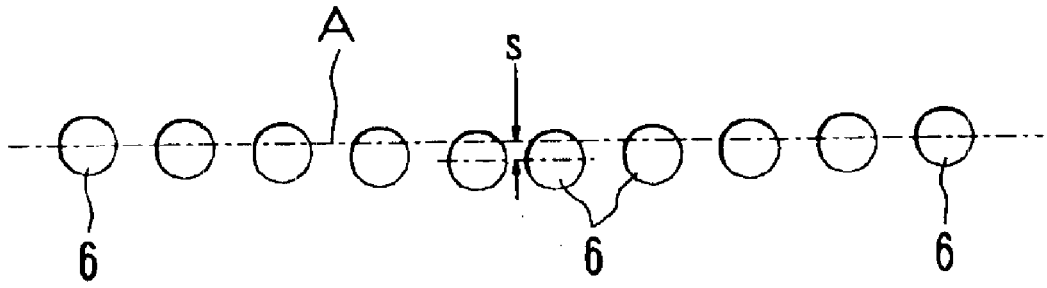
FIG. 1(B) is an explanatory diagram showing an arranged state of nozzles.

A description will be given below of the construction of an ink jet head according to the present invention. FIG. 1(A) is a perspective view showing an example of an ink jet head according to the present invention and FIG. 1(B) is an explanatory diagram showing an arranged state of nozzles.

An ink jet head H2 embodying the present invention is made up of a head substrate 1 formed with plural grooves (to be described later) into which ink is fed, a nozzle plate 2 bonded to a front end face of the head substrate 1, a channel-formed member 3 bonded to one side of the head substrate 1, a top plate 4 which closes a top surface of the channel-formed member 3, and an ink supply member 5 bonded to the top plate 4.

The channel-formed member 3, which has a frame-like shape, is for internally intercommunicating plural grooves formed in the head substrate 1. The head substrate 1 is formed of a piezoelectric material, and side walls to be described later are formed between adjacent ones of the plural grooves formed in the head substrate 1, with electrodes to be described later being formed in the interiors of the grooves respectively.

By apply voltage to the electrode formed in any of the grooves, side walls located on both sides of the groove are deformed and the volume of the groove changes at high speed. The ink jet head H2 is constructed such that during expansion of the groove volume, ink is fed into the groove, while during contraction of the groove volume, the ink present in the interior of the groove is ejected from an associated nozzle 6 formed in the nozzle plate 2. That is, in the ink jet head H2 of this embodiment, an actuator for the ejection of ink is constituted by both the piezoelectric material as the material of the head substrate 1 and the electrodes for the application of voltage to the piezoelectric material.

Next, the construction of the ink jet head H2 will be described below together with a first manufacturing method for the ink jet head according to the present invention. FIGS. 2 to 8 illustrate manufacturing steps in the first manufacturing method and FIG. 9 is a front view illustrating an ink jet head manufacturing step.

Figure 2:
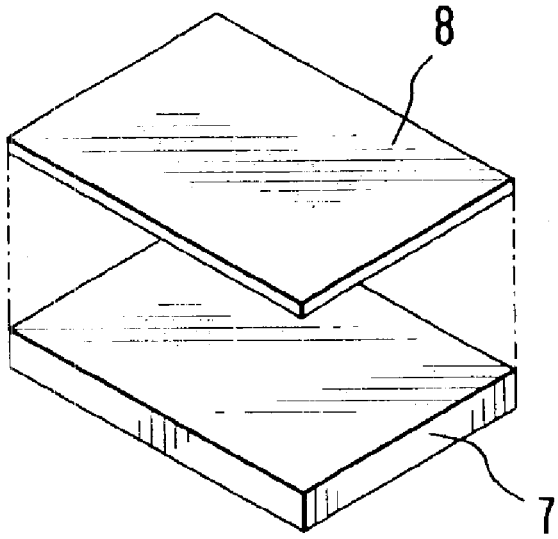
FIG. 2 is a perspective view showing a manufacturing step in a first manufacturing method for the ink jet head according to the present invention.

First, as shown in FIG. 2, there are provided two substrates 7 and 8 formed of a piezoelectric material polarized in the plate thickness direction. By bonding the two substrates with each other so as to be opposite in the direction of polarization there is formed a laminate substrate 9.

Figure 3:
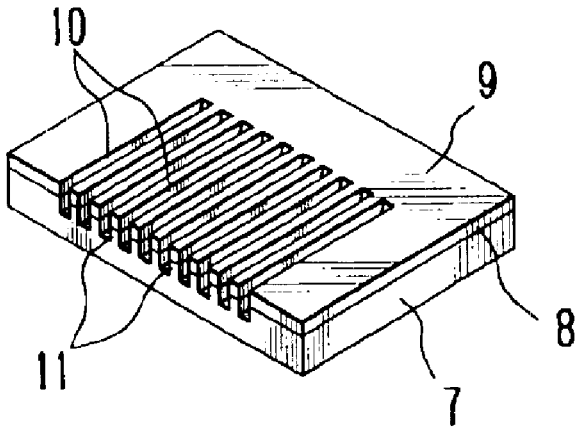
FIG. 3 is a perspective view showing a manufacturing step in the first manufacturing method.

Next, as shown in FIG. 3, plural grooves 10 are formed in parallel in one side of the substrate 8 so as to span the bonded surfaces of the two substrates 7 and 8. As a result there are formed plural grooves 10 and side walls 11 as partition walls between adjacent ones of the grooves 10 (grooves/side walls forming step). The grooves 10 can be formed easily by a grinding work using for example a diamond wheel of a dicing saw for cutting IC wafer. The size of each groove 10 is determined according to the specification of the ink jet head H2. More specifically, given that the length and depth of the head substrate 1 are 140 mm and 40 mm, respectively, the depth, width and length of each groove 10 are determined in the ranges of 0.1 to 1 mm, 20 to 200 $\mu$m, and 2 to 200 mm, respectively.

Figure 4:
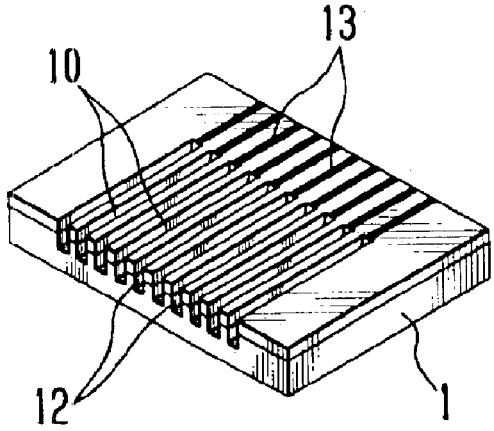
FIG. 4 is a perspective view showing a manufacturing step in the first manufacturing method.
Figure 5:
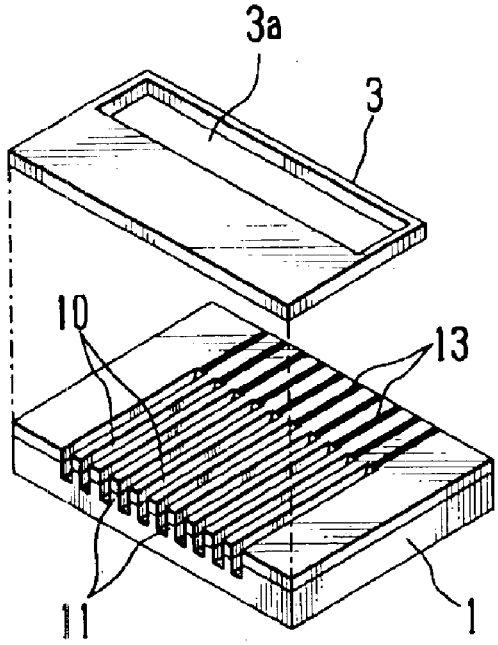
FIG. 5 is a perspective view showing a manufacturing step in the first manufacturing method.

Next, as shown in FIG. 4, electrodes 12 are formed on inner surfaces of the grooves 10 and wiring patterns 13 connected to the electrodes 12 are formed on one side of the head substrate 1, whereby the head substrate 1 provided with an actuator is fabricated (head substrate fabricating step). In this example, the electrodes 12 and the wiring patterns 13 are formed by an electroless plating method using a wet process.

Although the actuator for the ejection of ink fed into the grooves 10 is constituted by both the piezoelectric material as the material of the substrates 7, 8 and the electrodes 12 for the application of voltage to the piezoelectric material, only one of the substrates 7 and 8 may be a piezoelectric member. Further, it is also possible to fabricate the head substrate using only a single substrate 7 made of a piezoelectric material.

Next, a frame-like channel-formed member 3 having a central channel 3*a* is bonded to one side of the head substrate 1. In this embodiment, the channel-formed member 3 is also formed of a piezoelectric material like the material of the substrates 7 and 8 and its thermal expansion coefficient is $4\times10^{-6}$/° C.

Figure 6:
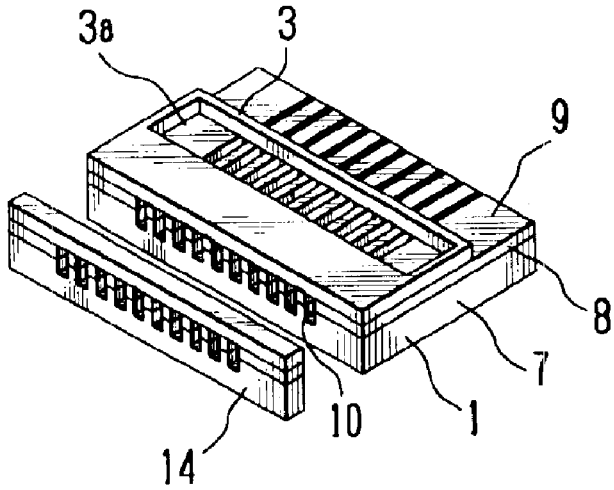
FIG. 6 is a perspective view showing a manufacturing step in the first manufacturing method.

Then, as shown in FIG. 6, the head substrate 1 and the channel-formed member 3 are cut off on the front end side of grooves 10. This cutting work is performed for making the grooves 10 uniform in length, and indicated at 14 is a cut piece resulting from the cutting work.

Figure 7:
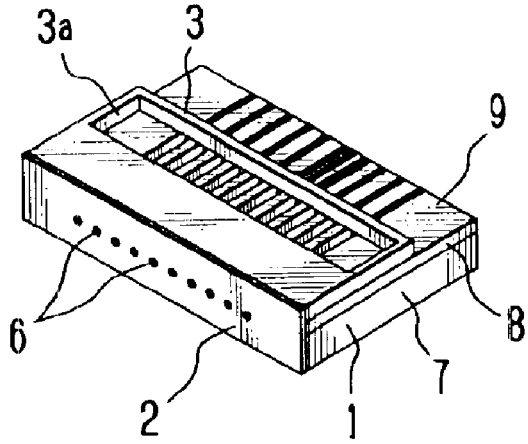
FIG. 7 is a perspective view showing a manufacturing step in the first manufacturing method.

Next, as shown in FIG. 7, a nozzle plate 2 is bonded to the front ends of the head substrate 1 and the channel-formed member 3 (nozzle plate bonding step). It is preferable that nozzles 6 are formed after bonding the nozzle plate 2 to the head substrate 1. However, the nozzle plate 2 pre-formed with nozzles 6 may be bonded to the head substrate 1, provided the alignment accuracy of the nozzle plate 2 relative to the head substrate 1 is enhanced by improvement of a jig or the like.

Figure 8:
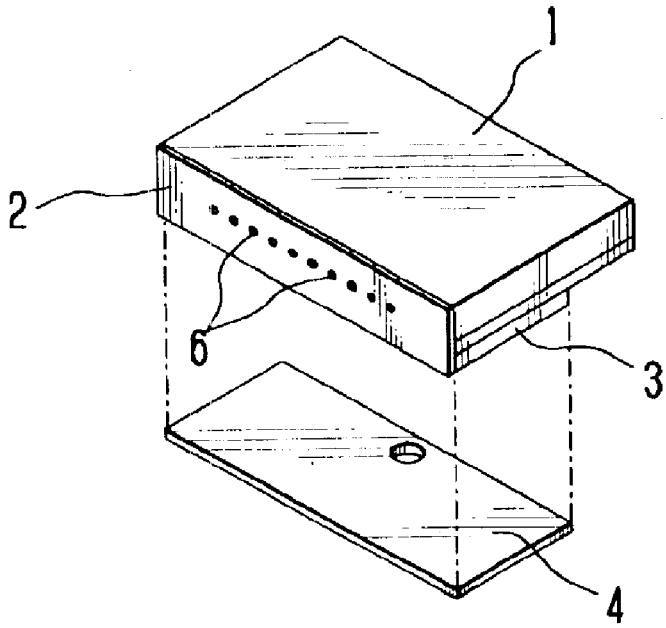
FIG. 8 is a perspective view showing a manufacturing step in the first manufacturing method.
Figure 9:
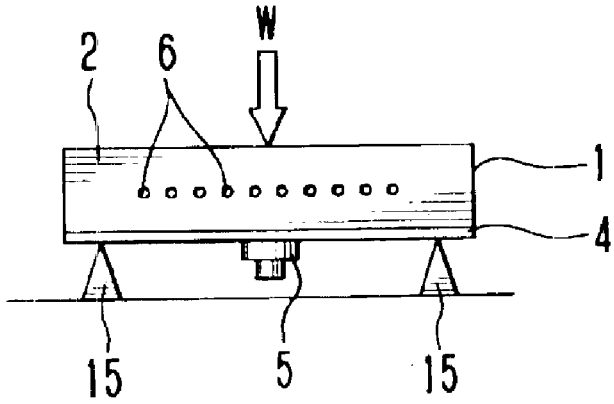
FIG. 9 is a front view showing a manufacturing step in the first manufacturing method.

Subsequently, a shift is made to such a top plate bonding step as shown in FIGS. 8 and 9. In the illustrated example, the top plate 4 is not directly bonded to the head substrate 1, but is bonded to the head substrate indirectly through the channel formed member 3. In the case where a recess for intercommunication of the grooves 10 is formed in an inner surface of the top plate 4 the top plate fulfills the function of the channel-formed member 3 and therefore it may be bonded directly to the head substrate 1. In this example, moreover, the top plate 4 is also formed of a piezoelectric material like the material of the substrates 7, 8 and the channel-formed member 3. The ink supply member 5 is formed of a metallic material such as SUS having a thermal expansion coefficient of $16.5\times10^{-6}$/° C. higher than that of the piezoelectric material, and the top plate 4 with the ink supply member 5 pre-bonded thereto is bonded to the channel-formed member 3 (top plate bonding step).

This top plate bonding step is carried out while keeping the head substrate 1 and the top plate 4 superimposed one on the other and in a state in which there is applied to the head substrate and the top plate such a load W as ensures a horizontal state of the head substrate and the top plate after curing of the adhesive. The "horizontal state" as referred to herein is included in the concept of "parallel state." More specifically, as shown in FIG. 9, both longitudinal ends of the top plate 4 are supported by fulcrums 15, and the load W is imposed on a flat surface of the head substrate 1 on the side opposite to the top plate 4. In this example an appropriate load W was found to be 1 kg.

Therefore, even if the heat of the metallic ink supply member 5 rises due to the heat generated with curing the thermosetting adhesive and the ink supply member 5 pulls the top plate 4 in the course of drop of its temperature, the head substrate 1, the channel-formed member 3 and the top plate 4 are prevented from warping and hence the nozzle plate 2 is prevented from deformation, whereby it is possible to minimize a positional deviation of each nozzle 6.

The ink jet head H2 thus completed showed that when the length and width of the head substrate 1 were set at 140 mm and 40 mm, respectively, as shown in FIG. 1(B), central deviations "s" of inside nozzles were within 5 $\mu$m with respect to a virtual straight line A joining the centers of nozzles 6 located at both ends. Although the virtual straight line A is a straight line joining the centers of both-end nozzles 6, this constitutes no limitation, but it may be, for example, a straight line joining the centers of two penultimate nozzles 6 inside both ends, or a straight line joining the centers of nozzles 6 located near both ends.

As noted above, in case of bonding the top plate 4 and the ink supply member 5 with each other beforehand and thereafter bonding the top plate 4 to the head substrate 1 through a thermosetting adhesive, if there is adopted the method wherein the top plate 4 is bonded to the channel-formed member 3 while keeping the head substrate 1 and the top plate 4 superimposed one on the other and while there is applied to the head substrate 1 and the top plate 4 such a load W as ensures a parallel state of the head substrate and the top plate after curing of the adhesive, as shown in FIG. 9, the top plate 4 may be formed of a material having a thermal expansion coefficient equal to that of the ink supply member 5. For example, even if the top plate 4 is formed of SUS like the ink supply member 5, it is possible to prevent the occurrence of warp as is the case with the foregoing. In this example, it turned out that a load W of 1.5 kg was appropriate.

Figure 11:
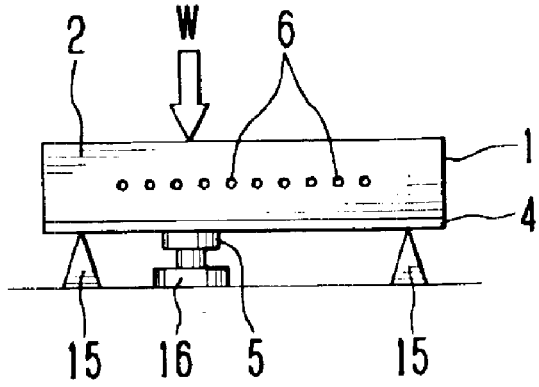
FIG. 11 is a front view showing in what state a load is applied to a top plate at a position opposed to an ink supply member.
Figure 12A:
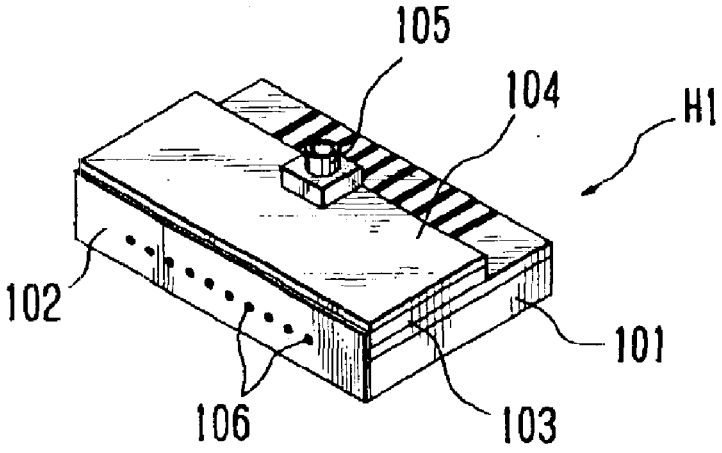
FIG. 12(A) is a perspective view showing an example of a conventional ink jet head.
Figure 12B:
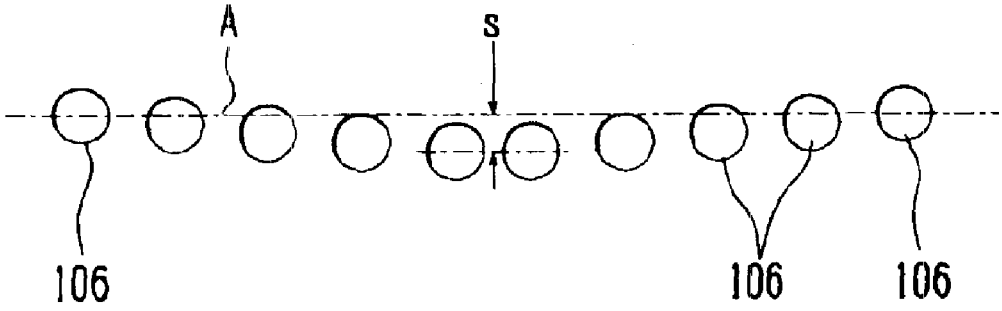
FIG. 12(B) is an explanatory diagram showing an arranged state of nozzles.
Figure 13:
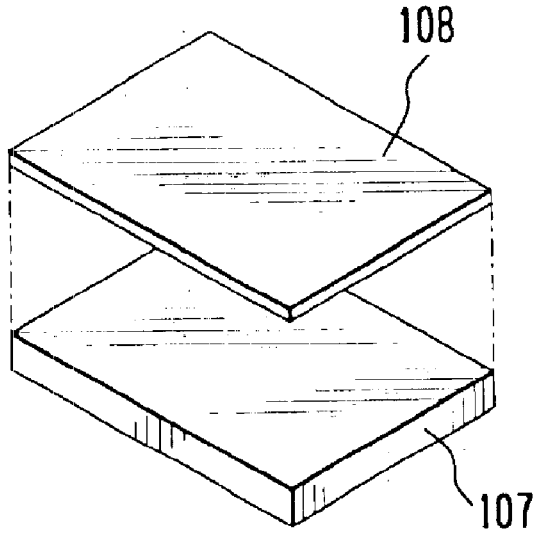
FIG. 13 is an explanatory diagram showing a manufacturing step in a conventional ink jet head manufacturing method.
Figure 14:
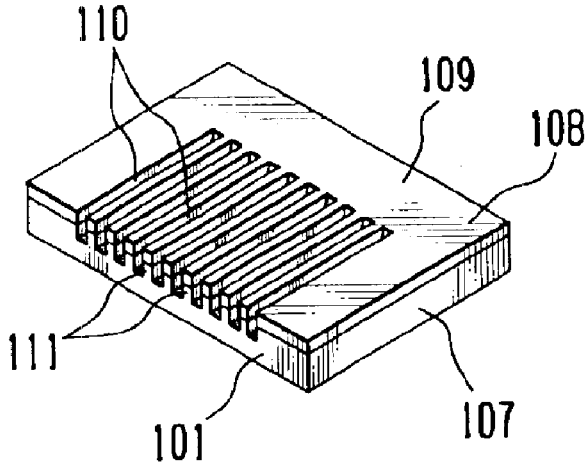
FIG. 14 is an explanatory diagram showing a manufacturing step in the conventional ink jet head manufacturing method.
Figure 15:
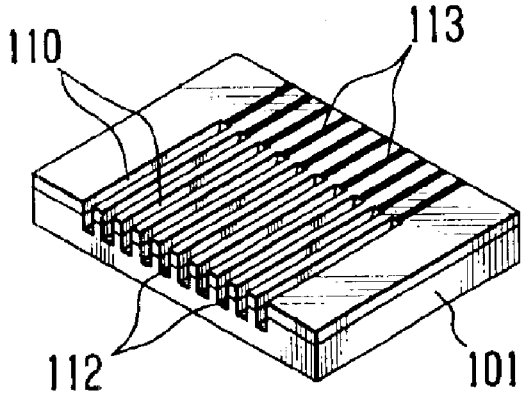
FIG. 15 is an explanatory diagram showing a manufacturing step in the conventional ink jet head manufacturing method.
Figure 16:
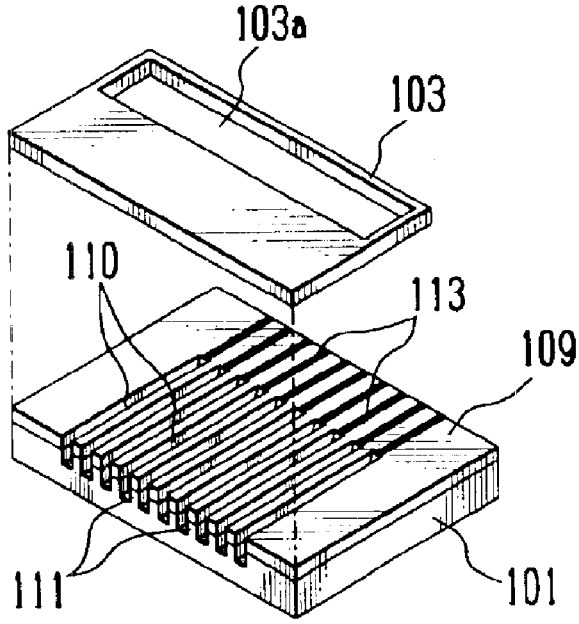
FIG. 16 is an explanatory diagram showing a manufacturing step in the conventional ink jet head manufacturing method.
Figure 17:
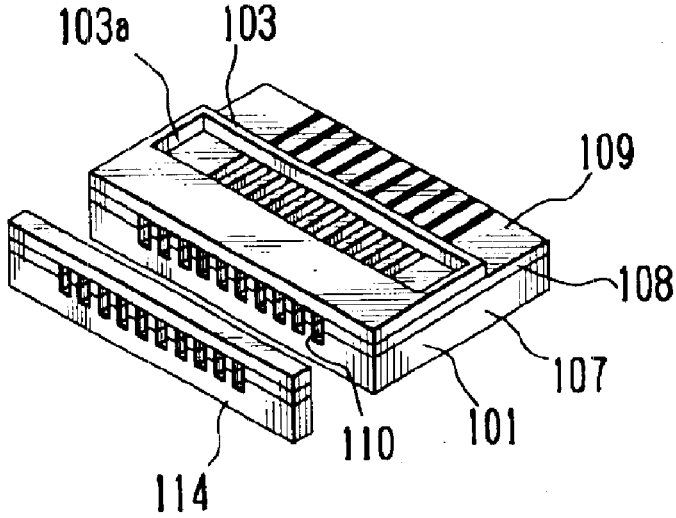
FIG. 17 is an explanatory diagram showing a manufacturing step in the conventional ink jet head manufacturing method.
Figure 18:
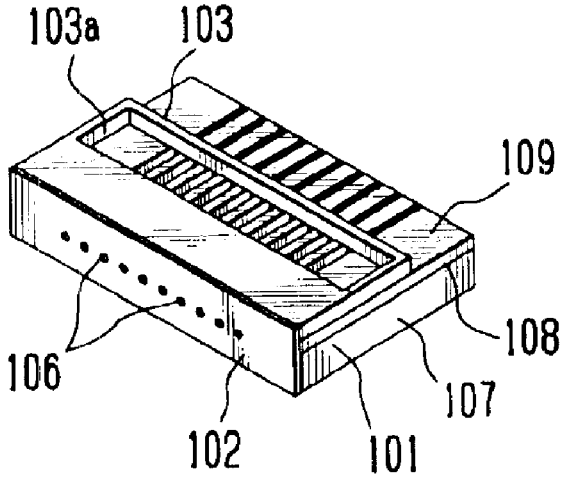
FIG. 18 is an explanatory diagram showing a manufacturing step in the conventional ink jet head manufacturing method.
Figure 19:
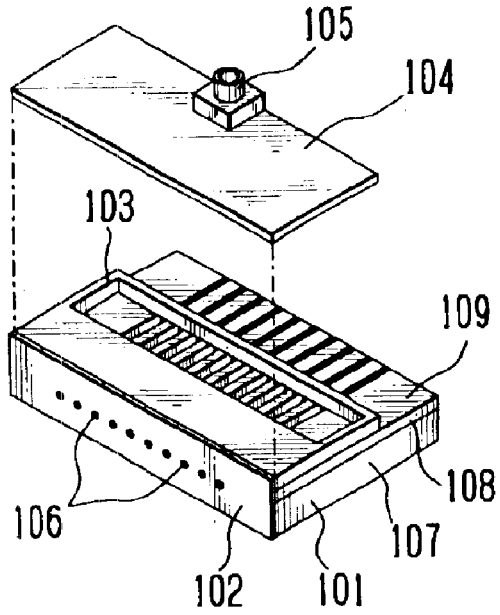
FIG. 19 is an explanatory diagram showing a manufacturing step in the conventional ink jet head manufacturing method.
Figure 20:
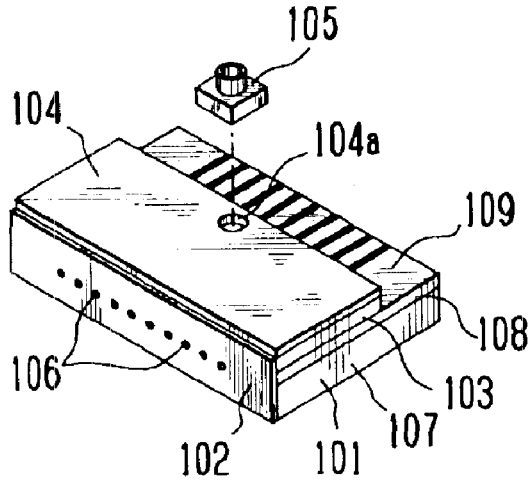
FIG. 20 is an explanatory diagram showing a manufacturing step in the conventional ink jet head manufacturing method.

In the case where both longitudinal ends of the top plate 4 are supported by fulcrums 15 and the load W is imposed on the flat surface of the head substrate 1 on the side opposite to the top plate 4, as shown in FIG. 9, in order to obtain a state in which the load of ensuring a horizontal state of the head substrate 1 and the top plate 4 is applied to the head substrate and the top plate while keeping the two superimposed one on the other, the ink supply member 5 may be connected to a position deviated from the center of the top plate 4 (see FIG. 11). In this case, for maintaining-the-top plate 4 in a horizontal state, it is more effective to apply the load W to a position opposed to the ink supply member 5 on the flat surface of the head substrate 1 on the side opposite to the top plate.

Next, a description will be given below of a second ink jet head manufacturing method according to a second embodiment of the present invention. In this second embodiment, the same portions as in the first embodiment are identified by the same reference numerals, and explanations thereof will be omitted.

This second manufacturing method comprises a grooves/side walls forming step (see FIGS. 2 and 3) for forming grooves 10 and side walls 11 on substrates 7 and 8, a head substrate fabricating step (see FIG. 4) for fabricating a head substrate 1 by forming on the substrates. 7 and 8 an actuator for applying an ejecting pressure to ink which has been fed into grooves 10, a nozzle-plate bonding step (see FIG. 7) for bonding a nozzle plate 2 to a front end face-of the head substrate 1, a top plate bonding step (see FIG. 10) for bonding to one side of the head substrate 1 directly or indirectly a top plate 4 formed of a material (a piezoelectric material in this example) having a thermal expansion coefficient equal to that of the head substrate 1 and closing the grooves 10, and an ink supply member bonding step for bonding an ink supply member 5 to the top plate 4 through a thermosetting adhesive while applying a load to the head substrate 1 and the top plate 4 so that the head substrate and the top plate are kept horizontal with respect to each other even after curing of the adhesive, the ink supply member 5 being formed of a material (in this example a metallic material such as SUS like that referred to in the previous discussion) having a thermal expansion coefficient higher than that of the top plate 4. The "horizontal state" as referred to herein is included in the concept of "parallel state."

As in the previous embodiment, an actuator in this embodiment is also composed of a piezoelectric material as the material of the substrates 7, 8 and electrodes 12 for the application of voltage to the piezoelectric material.

Figure 10:
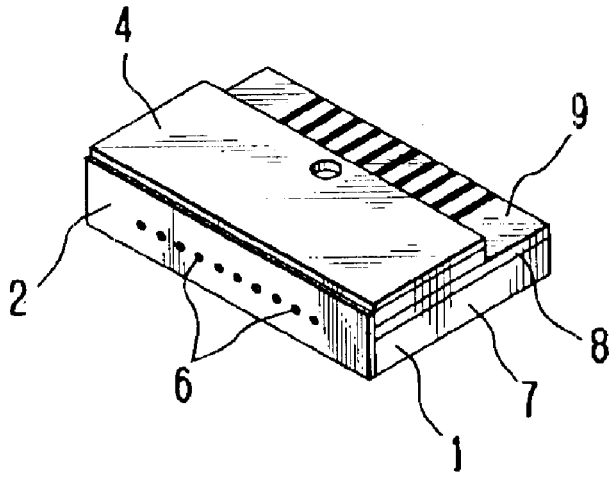
FIG. 10 is an explanatory diagram showing a top plate bonding step in a second manufacturing method for the ink jet head according to the present invention.

In the top plate bonding step shown in FIG. 10, the top plate 4 does not warp because it is formed of a piezoelectric material having the same thermal expansion coefficient as that of the head substrate 1. As in the previous embodiment, when bonding the metallic ink supply member 5 to the top plate 4 through a thermosetting adhesive, the bonding is done while keeping the head substrate 1 and the top plate 4 superimposed one on the other and while applying a load to the head substrate 1 and the top plate 4 so that the head substrate and the top plate are maintained in a horizontal state after curing of the adhesive (this state corresponds to an excluded state of the ink supply member 5 in FIG. 9). By so doing, it is possible to prevent warping of the head substrate 1 and the top plate 4.

In the ink supply member bonding step, in order to maintain the head substrate 1 and the top plate 4 in a loaded state such that both are kept parallel to each other also after curing of the adhesive, for example as shown in FIG. 11, both ends of the top plate 4 are supported by fulcrums 15 to maintain the head substrate 1 and the top plate 4 (a laminate comprising the head substrate 1 and the top plate 4) in a horizontal state, the ink supply member 5 is supported by a highly rigid member 16, and the load W (a force acting on an object) is applied to the flat surface of the head substrate 1 on the side opposite to the top plate 4 and at a position opposed to the ink supply member 5. As a result, the ink supply member 5 receives a reaction force based on the load W from the member 16.

The present invention is also applicable to an ink jet head of the type in which a heating element as an actuator is provided in each of many grooves formed in a substrate for the supply of ink, as well as a manufacturing method for such an ink jet head.

According to the manufacturing method for the ink jet head H2 of the present invention, even in the case where the thermal expansion coefficient of the ink supply member 5 is higher than that of the head substrate 1, or even in the case where the thermal expansion coefficients of both ink supply member 5 and top plate 4 are higher than the thermal expansion coefficient of the head substrate 1, it is possible to prevent the occurrence of warp of the head substrate 1 and the top plate 4 at the time of curing of the thermosetting resin, whereby the nozzles 6 formed in the nozzle plate 2 can be arranged substantially in alignment with one another.

Obviously, numerous modifications and variations of the present invention are possible in light of the above teachings. It is therefore to be understood that within the scope of the appended claims, the invention may be practiced otherwise than as specifically described herein.

What is claimed is:

1. A method of manufacturing an ink jet head, comprising:

a grooves/side walls forming step of forming on a substrate a plurality of grooves arranged in parallel with one another and side walls as partition walls between the grooves;

a head substrate fabricating step of fabricating a head substrate by providing on the substrate an actuator for applying an ejecting pressure to ink fed into each of the grooves;

a nozzle plate bonding step of bonding a nozzle plate to a front end face of the head substrate; and a top plate bonding step of bonding to one side of a head substrate directly or indirectly through a thermosetting adhesive, a top plate which covers the grooves and to which an ink supply member formed of a material having a thermal expansion coefficient higher than that of the head substrate is pre-bonded, while keeping the head substrate and the top plate superimposed one on the other and while applying to the head substrate and the top plate such a load as maintains the head substrate and the top plate in parallel with each other after-curing of the adhesive.

2. A method of manufacturing an ink jet head according to claim 1, wherein the top plate is formed of a material having a thermal expansion coefficient equal to that of the ink supply member.

3. A method of manufacturing an ink jet head according to claim 1, wherein the top plate bonding step comprises supporting both longitudinal ends of the top plate by means of fulcrums and applying the load to a flat surface of the head substrate on the side opposite to the top plate and at a position opposed to the ink supply member, in order to maintain the state in which the load for maintaining the head substrate and the top plate in parallel with each other also after curing of the adhesive is applied to the head substrate and the top plate while keeping the head substrate and the top plate superimposed one on-the other.

4. A method of manufacturing an ink jet head, comprising:

a grooves/side walls forming step of forming a plurality of grooves arranged in parallel with one another and side walls as partition walls between the grooves;

a head substrate fabricating step of fabricating a head substrate by providing on the substrate an actuator for applying an ejecting pressure to ink fed into each of the grooves;

a nozzle plate bonding step of bonding a nozzle plate to a front end face of the head substrate;

a top plate bonding step of bonding a top plate for closing the grooves to one side of the head substrate directly or indirectly, the top plate being formed of a material having a thermal expansion coefficient equal to that of the head substrate; and an ink supply member bonding step of bonding an ink supply member to the top plate through a thermosetting adhesive while applying to the head substrate and the top plate such a load as maintains the head substrate and the top plate in parallel with each other even after curing of the adhesive, the ink supply member having a thermal expansion coefficient higher than that of the top plate.

5. A method of manufacturing an ink jet head according to claim 4, wherein in the ink supply member bonding step, the head substrate and the top plate are supported in a mutually parallel state and the load is applied to the ink supply member and also to a flat surface of the head substrate on the side opposite to the top plate and at a position opposed to the ink supply member, in order to maintain the state in which the load for maintaining the head substrate and the top plate in parallel with each other also after curing of the adhesive is applied to the head substrate and the top plate.

6. An ink jet head comprising:

a head substrate provided, at a substrate, with a plurality of grooves arranged in parallel with one another and side walls as partition walls between the grooves, and provided with an actuator for applying an ejecting pressure to ink fed into each of the grooves;

a nozzle plate having nozzles opposed to front ends of the grooves and bonded to a front end face of the head substrate;

a top plate bonded to one side of the head substrate directly or indirectly to close open sides of the grooves; and an ink supply member formed of a material having a thermal expansion coefficient higher than that of the head substrate and bonded to the top plate to supply ink to each of the grooves, wherein the nozzles are arranged at positions at which the distance of each nozzle center deviated from a virtual straight line is not larger than 5 $\mu$m, the virtual straight line joining the centers of nozzles located at both ends or thereabouts in the nozzle arranged direction.

7. An ink jet head according to claim 6, wherein the virtual straight line is a straight line joining the centers of the nozzles located at both ends in the nozzle arranged direction.

* * * * *